US008693915B2

(12) United States Patent
Nozaki et al.

(10) Patent No.: US 8,693,915 B2
(45) Date of Patent: Apr. 8, 2014

(54) IMAGE FORMING APPARATUS INCLUDING CHARGERS AROUND WHICH AIR PASSES

(75) Inventors: Takahiro Nozaki, Nagoya (JP); Takuya Yamaguchi, Toyokawa (JP); Yoshiteru Hattori, Ichinomiya (JP); Yohsuke Hata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 122 days.

(21) Appl. No.: 13/397,728

(22) Filed: Feb. 16, 2012

(65) Prior Publication Data

US 2012/0219314 A1 Aug. 30, 2012

(30) Foreign Application Priority Data

Feb. 28, 2011 (JP) ..... 2011-041583

(51) Int. Cl.
*G03G 21/20* (2006.01)
*G03G 21/18* (2006.01)

(52) U.S. Cl.
USPC ..... 399/92; 399/94; 399/110

(58) Field of Classification Search
USPC ..... 399/92, 94, 110, 111, 112
See application file for complete search history.

(56) References Cited

U.S. PATENT DOCUMENTS

| | | | | |
|---|---|---|---|---|
| 7,415,218 | B2 | 8/2008 | Hori et al. | |
| 7,426,355 | B2 | 9/2008 | Okabe | |
| 7,778,570 | B2 * | 8/2010 | Numagami et al. | 399/111 |
| 7,840,156 | B2 * | 11/2010 | Inaba | 399/92 |
| 7,941,069 | B2 * | 5/2011 | Idehara et al. | 399/92 |
| 2006/0024083 | A1 | 2/2006 | Hori et al. | |
| 2007/0036581 | A1 | 2/2007 | Okabe | |
| 2007/0146739 | A1 * | 6/2007 | Igarashi | 358/1.7 |
| 2009/0285588 | A1 * | 11/2009 | Furuichi et al. | 399/94 X |

FOREIGN PATENT DOCUMENTS

| | | | |
|---|---|---|---|
| CN | 1719346 | A | 1/2006 |
| JP | 09-292805 | | 11/1997 |
| JP | 2001-337499 | | 12/2001 |
| JP | 2005-090574 | | 4/2005 |
| JP | 2007-072421 | | 3/2007 |
| JP | 2008-051937 | | 3/2008 |
| JP | 2010-002711 | * | 1/2010 |

OTHER PUBLICATIONS

CN Office Action mailed Jun. 26, 2013, CN Appln. 201210027635.1, English translation.

* cited by examiner

*Primary Examiner* — Sophia S Chen
(74) *Attorney, Agent, or Firm* — Banner & Witcoff, Ltd.

(57) ABSTRACT

An image forming apparatus includes a plurality of process cartridges and a pair of frames. Each of the plurality of process cartridges includes a photosensitive drum, a charger and a charger supporting wall. One of the pair of frames has a plurality of first openings such that air outside the pair of frames is sucked between the pair of frames through the first openings. The other of the pair of frames has a plurality of second openings such that air between the pair of frames is discharged outside the pair of frames through the second openings. The first openings are positioned on an opposite side of the charger supporting wall from the photosensitive drum. The second openings are positioned on the same side of the charger supporting wall as the photosensitive drum.

9 Claims, 7 Drawing Sheets

IMAGE FORMING APPARATUS INCLUDING CHARGERS AROUND WHICH AIR PASSES

CROSS REFERENCE TO RELATED APPLICATION

The present application claims priority from Japanese Patent Application No. 2011-041583, which was filed on Feb. 28, 2011, the disclosure of which is incorporated herein by reference in its entirety.

BACKGROUND

1. Field of the Invention

The present invention relates to an image forming apparatus having a charger that charges a photosensitive drum.

2. Description of the Related Art

An image forming apparatus is known that irradiates a charged photosensitive drum with laser light, thereby forms an electrostatic latent image on the photosensitive drum, transfers a developer image formed by supplying developer to the electrostatic latent image to paper, and thereby forms an image on the paper.

Such an image forming apparatus includes a charging wire charging the photosensitive drum, and when a voltage is applied to the charging wire, ions are generated around the charging wire, and the ions move in the form of an ion wind toward the photosensitive drum and hit the photosensitive drum, thereby charging the photosensitive drum.

In the image forming apparatus, in the case where an ion wind generated from the charging wire and hitting the photosensitive drum is contaminated by foreign material attached to the photosensitive drum, and if this ion wind flows backward from the photosensitive drum to the charging wire, the foreign material attaches to the charging wire and thereby degrades the charging performance.

SUMMARY

A need has arisen to provide an image forming apparatus capable of maintaining the charging performance.

According to an embodiment of the present invention, an image forming apparatus includes a plurality of process cartridges and a pair of frames. The plurality of process cartridges are arranged in one direction. Each of the plurality of process cartridges includes a photosensitive drum, a charger configured to charge the photosensitive drum and a charger supporting wall supporting the charger. The pair of frames is disposed on an outer side in an axial direction of the photosensitive drums and is configured to support the plurality of process cartridges therebetween. One of the pair of frames has a plurality of first openings which correspond to the plurality of process cartridges such that air outside the pair of frames is sucked between the pair of frames through the plurality of first openings. The other of the pair of frames has a plurality of second openings which correspond to the plurality of process cartridges such that air between the pair of frames is discharged outside the pair of frames through the plurality of second openings. As viewed from the axial direction, the first openings are positioned on an opposite side of the charger supporting wall from the photosensitive drum. The second openings are positioned on the same side of the charger supporting wall as the photosensitive drum.

DESCRIPTION OF THE PREFERRED EMBODIMENTS

Next, an embodiment of the present invention will be described in detail with reference to the drawings. In the following description, first, the overall structure of a color printer as an example of an image forming apparatus will be described, and then the details of the characterizing portion of the present invention will be described.

In the following description, terms such as front, rear, left, right, top, and bottom are used to refer to directions relative to a user using the color printer. That is to say, "front" means the right side of FIG. 1, "rear" means the left side of FIG. 1, "right" means the far side of the paper plane of FIG. 1, "left" means the near side of the paper plane of FIG. 1, and "top-bottom direction" means the top-bottom direction of FIG. 1.

Figure 1:
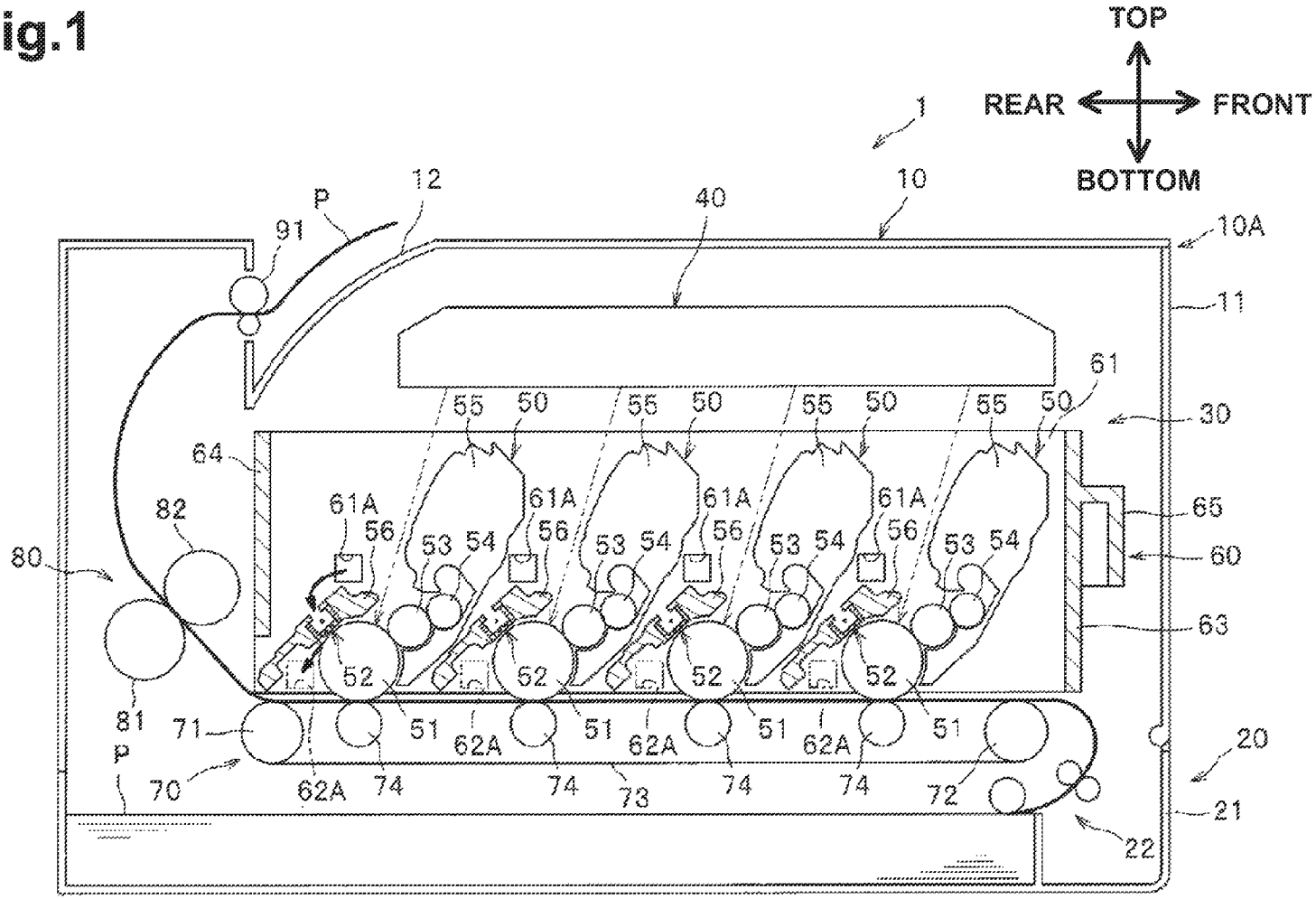
FIG. 1 is an explanatory diagram showing a color printer according to an embodiment of the present invention.

As shown in FIG. 1, the color printer 1 has a paper feed portion 20 that feeds paper P into the apparatus main body 10, and an image forming portion 30 that forms an image on paper P fed.

The paper feed portion 20 has a paper feed tray 21 that houses paper P, and a paper conveying device 22 that conveys paper P from the paper feed tray 21 to the image forming portion 30.

The image forming portion 30 has a scanner unit 40, four (a plurality of) process cartridges 50, and a drawer 60 as an example of a photosensitive drum support that integrally supports the four process cartridges 50, a transfer unit 70, and a fixing unit 80.

The scanner unit 40 is placed in the upper part of the inside of the apparatus main body 10, and has a laser emitter, a polygon mirror, lenses, and reflecting mirrors (not shown). The scanner unit 40 rapidly scans the surface of the photosensitive drum 51 of each process cartridge 50 with a laser beam through the path shown by a long dashed double-short dashed line in FIG. 1.

The process cartridges 50 are arranged above the paper feed portion 20 in the front-rear direction (one direction), and each has a photosensitive drum 51, a charger 52, a developing roller 53, a feeding roller 54, a layer thickness restricting blade (not shown), and a toner chamber 55. Each process cartridge 50 is detachably provided in the drawer 60.

The drawer 60 is supported by the apparatus main body 10 movably in the front-rear direction and can be pulled out from the apparatus main body 10 through an opening 10A formed by opening a front cover 11 disposed in the front of the apparatus main body 10. The drawer 60 may be configured so as to be detachable from the apparatus main body 10 or may be configured so as to be nonremovable from the apparatus main body 10 unless a tool or the like is used.

The transfer unit 70 is provided between the paper feed portion 20 and the process cartridges 50, and has a driving roller 71, a driven roller 72, a conveying belt 73, and transfer rollers 74.

The driving roller 71 and the driven roller 72 are disposed away from each other in the front-rear direction and parallel to each other, and the conveying belt 73 that is an endless belt is provided in a tensioned state therebetween. The outer surface of the conveying belt 73 is in contact with each photosensitive drum 51. On the inner side of the conveying belt 73, four transfer rollers 74 are disposed so as to face the photosensitive drums 51 with the conveying belt 73 therebetween. At the time of transfer, a transfer bias is applied to the transfer rollers 74 by constant current control.

The fixing unit 80 is disposed behind the process cartridges 50 and the transfer unit 70, and has a heating roller 81 and a pressure roller 82 that is disposed so as to face the heating roller 81 and presses the heating roller 81.

In the image forming portion 30 configured as above, first, the surface of each photosensitive drum 51 is uniformly charged by the charger 52 and is then exposed by the scanner unit 40. This lowers the electrical potential of the exposed part, and an electrostatic latent image based on image data is formed on each photosensitive drum 51. After that, the developing roller 53 supplies toner (developer) in the toner chamber 55 to the electrostatic latent image on the photosensitive drum 51, and a toner image is borne on the photosensitive drum 51.

Next, paper P fed onto the conveying belt 73 passes the nip between each photosensitive drum 51 and corresponding transfer roller 74, and the toner image formed on each photosensitive drum 51 is transferred onto the paper P. The paper P passes through the nip between the heating roller 81 and the pressure roller 82, and the toner image transferred onto the paper P is heat-fixed.

The paper P heat-fixed in the fixing unit 80 is conveyed to a paper ejection roller 91 disposed downstream of the fixing unit 80, and is ejected from the paper ejection roller 91 onto the paper output tray 12.

[Structure around Charger 52]

Figure 2:
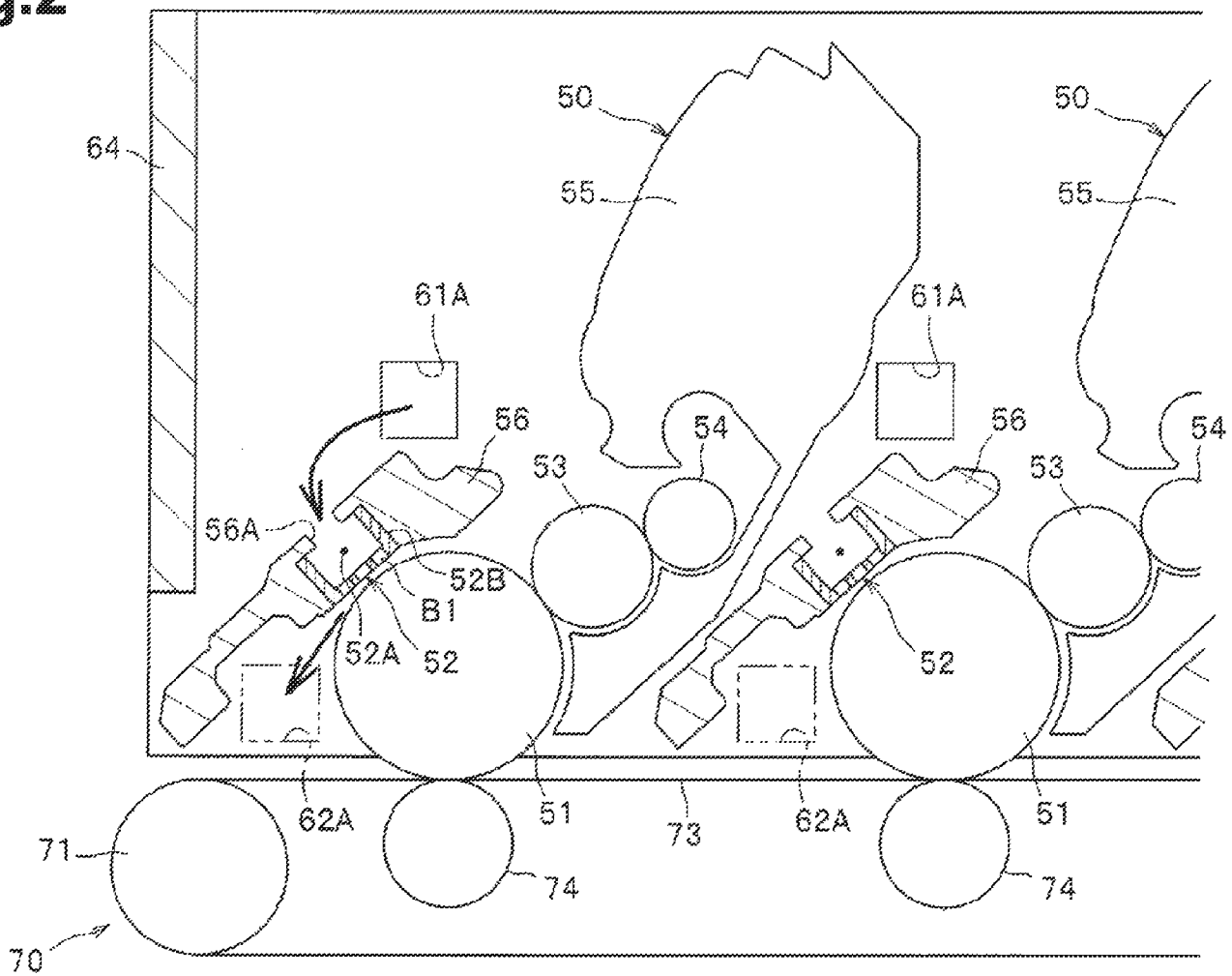
FIG. 2 is an enlarged view showing the structure around a charger.

Next, the structure around the charger 52 will be described in detail. As shown in FIG. 2, the charger 52 has a charging wire 52A and a grid electrode 52B that is U-shaped in cross-section and generates corona discharge between the charging wire 52A and the grid electrode 52B, and is supported by a charger supporting wall 56 disposed obliquely behind and above the photosensitive drum 51. The charger supporting wall 56 is part of the process cartridge 50 and is formed so as to cover the photosensitive drum 51. Specifically, the charger supporting wall 56 covers the photosensitive drum 51 so as to incline backward from a position above the photosensitive drum 51 and near the central part of the photosensitive drum 51. The lower end of the charger supporting wall 56 extends to the proximity of the lower part of the photosensitive drum 51 and is shaped so as to cover the entire photosensitive drum 51. The charger supporting wall 56 has a supporting hole 56A communicating with the inside and outside of the process cartridge 50. The charging wire 52A and the grid electrode 52B are provided so as to be located in this supporting hole 56A. The supporting hole 56A is formed along the axial direction of the photosensitive drum 51 (see FIG. 5).

The grid electrode 52B is disposed between the charging wire 52A and the photosensitive drum 51. In the lower wall part (the wall facing the photosensitive drum 51) of the grid electrode 52B, a plurality of slits B1 for generating corona discharge between the charging wire 52A and the grid electrode 52B are formed. The plurality of slits B1 is formed along the axial direction of the photosensitive drum 51 (not shown). Ions generated around the charging wire 52A head to the photosensitive drum 51 through the slits B1.

Figure 3A:
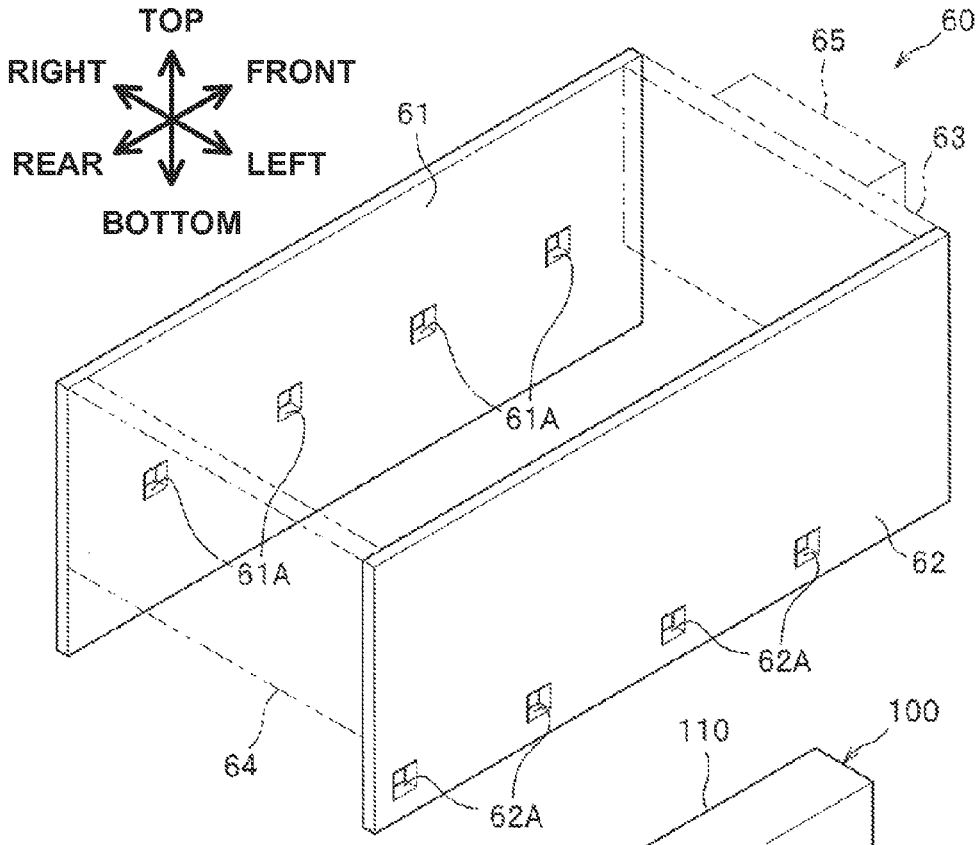
FIG. 3A is an explanatory diagram showing a drawer.

As shown in FIG. 3A, the drawer 60 has a pair of left and right plate-like side walls 61 and 62 serving as a pair of frames, plate-like front wall 63 and rear wall 64 that connect the front and rear ends of the side walls 61 and 62, and a handle 65 provided on the front surface of the front wall 63.

As shown in FIG. 1, the pair of side walls 61 and 62 (only the right side wall 61 is shown) are disposed on the outer side in the left-right direction (on the outer side in the axial direction) of each photosensitive drum 51, and support the plurality of process cartridges 50 such that the plurality of process cartridges 50 are put between the pair of side walls 61 and 62. The right side wall 61 is provided with a plurality of first openings 61A for sucking air on the outer side in the left-right direction of the pair of side walls 61 and 62 into the space between the pair of side walls 61 and 62. The left side wall 62 is provided with a plurality of second openings 62A (see FIG. 3A) for exhausting air in the space between the pair of side walls 61 and 62 to the outer side in the left-right direction of the pair of side walls 61 and 62.

The first openings 61A are rectangular through-holes corresponding to the process cartridges 50 and are provided above the charger supporting walls 56 (on the opposite side of the charger supporting walls 56 from the photosensitive drums 51) as viewed from the left-right direction. More specifically, four first openings 61A corresponding to the four process cartridges are provided above the chargers 52 and at positions where the first openings 61A do not overlap with the process cartridges 50 as viewed from the left-right direction. Thus, air can be smoothly introduced through the first openings 61A into the space between the pair of side walls 61 and 62. Therefore, it is easy to make such a flow that air entering through the first opening 61A into the space between the pair of side walls 61 and 62 flows from one end in the longitudinal direction of the charger 52 to the other end, then heads toward the supporting hole 56A of the charger supporting wall 56 (downward), and is sucked into the charger 52 (see FIG. 5).

The second openings 62A are rectangular through-holes corresponding to the process cartridges 50 and are provided below the charger supporting walls 56 (on the same side of the charger supporting walls 56 as the photosensitive drums 51) as viewed from the left-right direction. More specifically, the second openings 62A are disposed below the chargers 52 (on the upstream side in the rotation direction of the photosensitive drums 51), and each second opening 62A is disposed between the lower end of the corresponding inclined charger supporting wall 56 and the corresponding photosensitive drum 51. Thus, it is possible to make such an airflow that air introduced through the first opening 61A into the space between the pair of side walls 61 and 62 passes through the charger 52 and is then discharged through the second opening 62A, and it is possible to prevent air from flowing backward from the photosensitive drum 51 to the charger 52.

Each process cartridge 50 preferably has a hole or cutout facing the corresponding second opening 62A in its left side wall (side wall facing the corresponding second opening 62A). This makes it easy to suck the air in each process cartridge 50 through the corresponding second opening 62A. However, this hole or cutout is not indispensable, and the air in each process cartridge 50 can also be sucked through the corresponding second opening 62A and, for example, the opening in the bottom of the process cartridge 50 (the opening for exposing the photosensitive drum 51 to the outside).

Figure 3B:
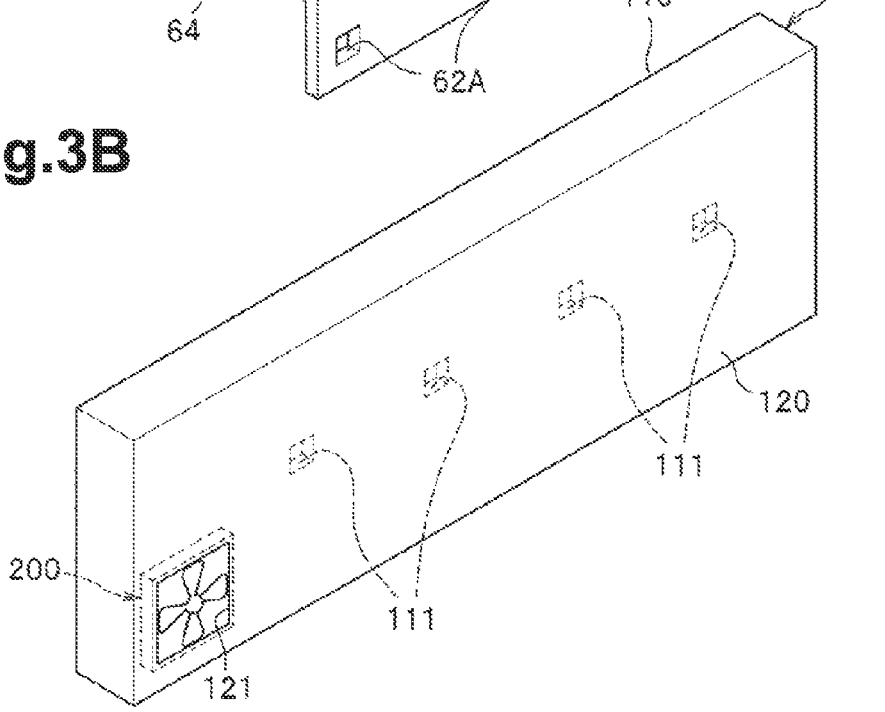
FIG. 3B is an explanatory diagram showing a duct.

Inside the apparatus main body 10, a duct 100 shown in FIG. 3B is provided. The duct 100 is formed in a hollow rectangular parallelepiped shape extending in the front-rear direction, and is disposed so as to be adjacent to the left side of the left side wall 62 of the drawer 60 attached to the apparatus main body 10 (see FIG. 5).

In the right side wall 110 of the duct 100, a plurality of third openings 111 facing the second openings 62A are formed. Through these, the space between the pair of side walls 61 and 62 communicates with the inside of the duct 100.

In addition, in the duct 100, an exhaust fan 200 is provided that discharges the air in the duct 100 (in the apparatus main body 10) to the outside of the apparatus main body 10. Specifically, the exhaust fan 200 is fixed to the left side wall 120 of the duct 100 so as to face the outside through a fan opening 121 formed in the lower rear part of the left side wall 120, and is configured to discharge the air in the duct 100 to the outside of the apparatus main body 10 through an exhaust opening that is formed in the left side wall (not shown) of the apparatus main body 10 so as to face the fan opening 121.

In other words, the duct 100 is formed as a path connecting the exhaust fan 200 and the second openings 62A. For this reason, it is possible to substantially evacuate the inside of the duct 100 with the exhaust fan 200 and to suck the air in the space between the pair of side walls 61 and 62 through the second openings 62A substantially uniformly into the duct 100.

Figure 4:
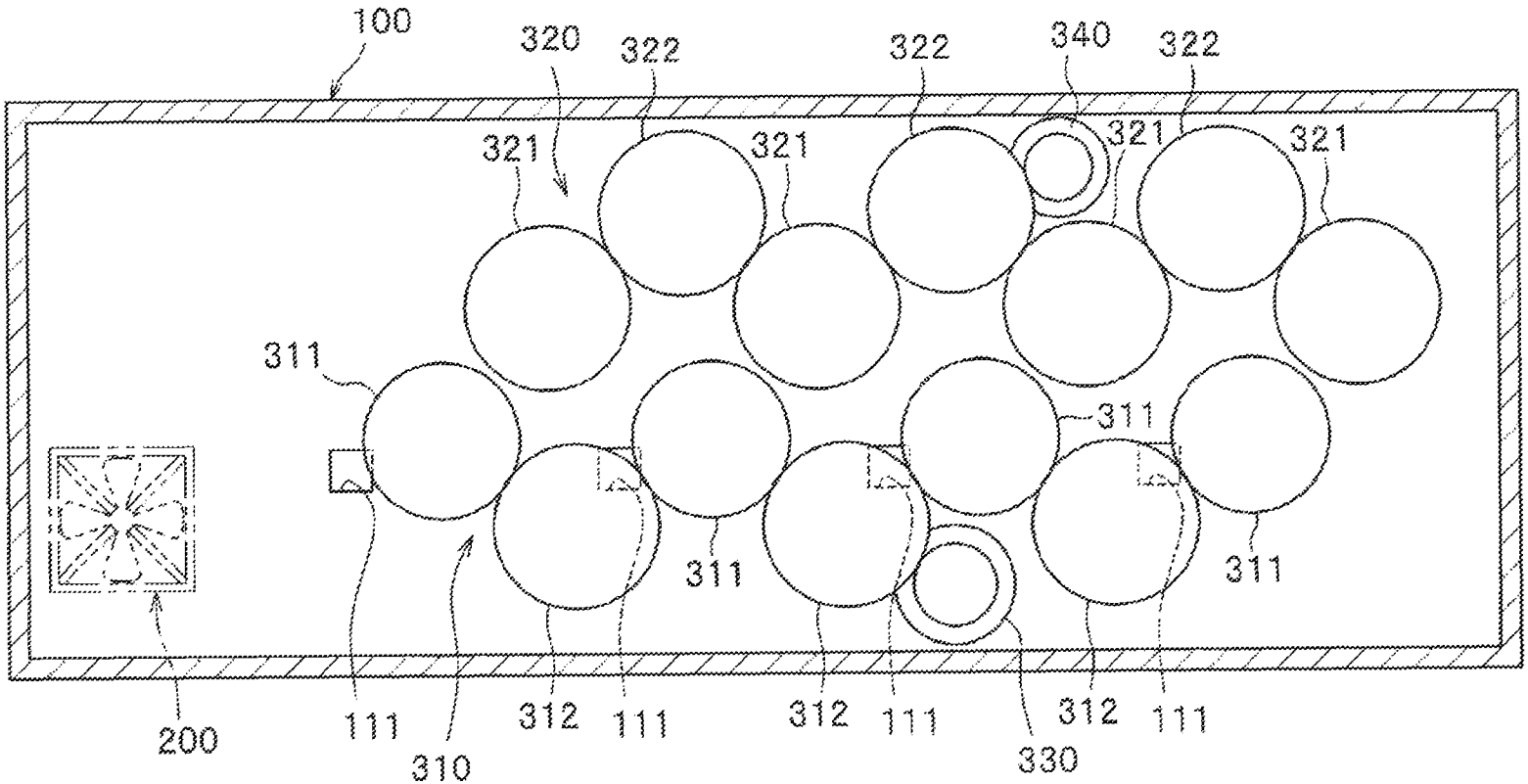
FIG. 4 is an explanatory diagram showing gear mechanisms and others in the duct.

As shown in FIG. 4, the duct 100 is provided therein with a first gear mechanism 310 for driving the plurality of photosensitive drums 51, a second gear mechanism 320 for driving the plurality of developing rollers 53 and others, and a first motor 330 and a second motor 340 as an example of a driving source for driving the first gear mechanism 310 and the a second gear mechanism 320.

The first gear mechanism 310 has output gears 311 corresponding to the photosensitive drums 51 and intermediate gears 312 meshing with adjacent output gears 311, and one of the intermediate gears 312 meshes with the first motor 330. The second gear mechanism 320 has output gears 321 corresponding to the developing rollers 53 and intermediate gears 322 meshing with adjacent output gears 321, and one of the intermediate gears 322 meshes with the second motor 340.

The output gears 311 and 321 are coupled to and uncoupled from the photosensitive drums 51 and the developing rollers 53 by known coupling mechanisms, and driving force is transmitted through these coupling mechanisms. Holes corresponding to the coupling mechanisms are formed in the left side wall 62 of the drawer 60 and the right side wall 110 of the duct 100.

As described above, the gear mechanisms 310 and 320 are disposed in the duct 100. Since the duct 100 is used as a gear box for housing the gear mechanisms 310 and 320, the number of parts can be reduced. Since the motors 330 and 340 are provided in the duct 100, the motors 330 and 340 can be cooled by the air flowing through the duct 100.

[Airflow Around Charger 52]

Figure 5:
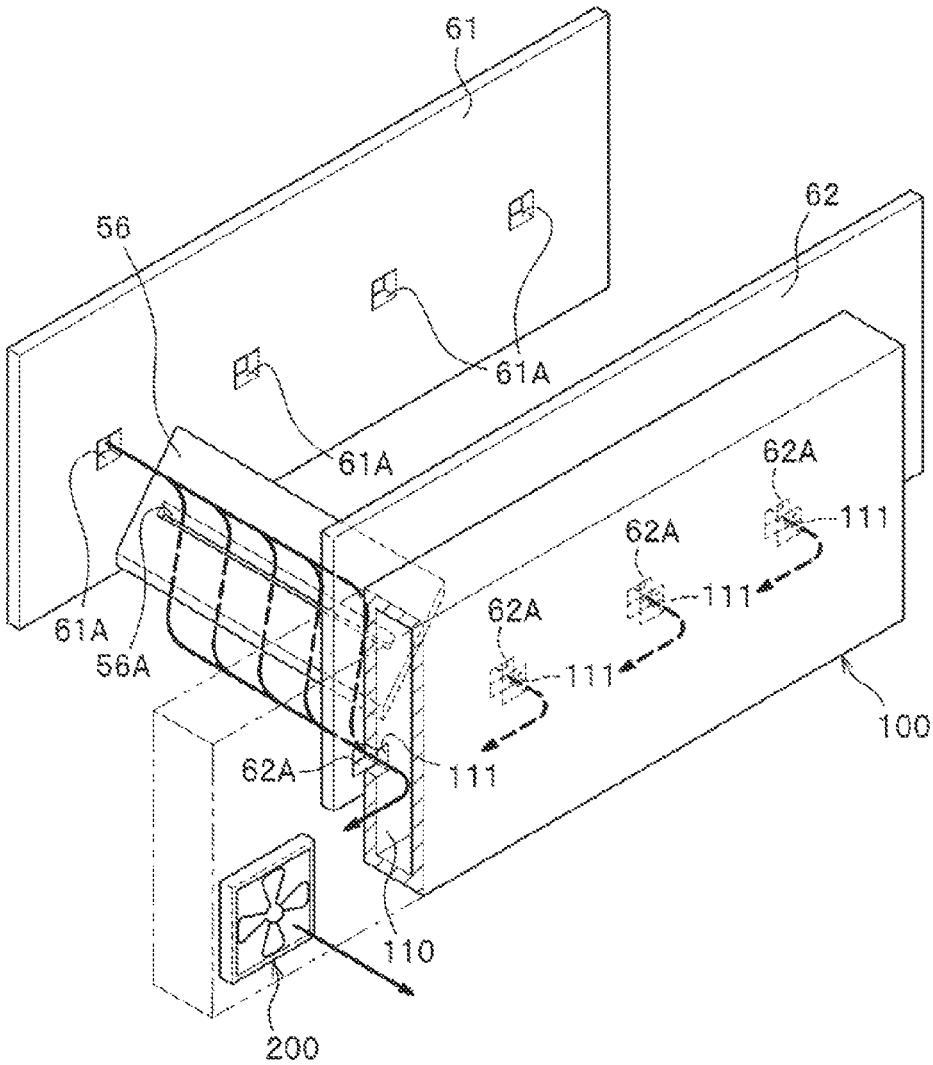
FIG. 5 is an explanatory diagram showing the airflow in a space between a pair of side walls.

Next, with reference to FIG. 5, the airflow around the charger 52 will be described in detail. In FIG. 5, for convenience sake, one charger supporting wall 56 is shown, and the other components of the process cartridge 50 are omitted.

As shown in FIG. 5, when the exhaust fan 200 is activated, the inside of the duct 100 is substantially evacuated, and the air in the space between the pair of side walls 61 and 62 is sucked through the second openings 62A into the duct 100. Since air is sucked through the second opening 62A located below the supporting hole 56A of the charger supporting wall 56, an airflow from the first opening 61A through the supporting hole 56A to the second opening 62A is formed in the space between the pair of side walls 61 and 62.

Specifically, the air entering the space between the pair of side walls 61 and 62 through the first opening 61A flows above the charger supporting wall 56 along the left-right direction to the proximity of the left side wall 62, and then flows downward into substantially the whole of the supporting hole 56A that is long in the left-right direction. After that, air heads to the photosensitive drum 51 through the charger 52 in the supporting hole 56A (through the slits B1), then flows along the left-right direction toward the second opening 62A, and is discharged through the second opening 62A to the outside of the space between the pair of side walls 61 and 62. Thus, air can be prevented from flowing backward from the photosensitive drum 51 to the charger 52.

In this embodiment described above, the following advantageous effects can be obtained. Since air can be prevented from flowing backward from the photosensitive drum 51 to the charger 52, foreign material on the photosensitive drum 51 can be prevented from attaching to and contaminating the charging wire 52A, and the charging performance can be maintained.

Since the first openings 61A are provided at positions where the first openings 61A do not overlap with the process cartridges 50 as viewed from the left-right direction, air can be smoothly introduced through the first openings 61A into the space between the pair of side walls 61 and 62. For this reason, it is easier to make such a flow that air entering the space between the pair of side walls 61 and 62 through the first opening 61A flows from one end in the longitudinal direction of the charger 52 to the other end, and is then sucked into the charger 52, and the backflow of air can be further prevented.

Since the duct 100 connecting the exhaust fan 200 and the second openings 62A is provided, the amount of air sucked through the second openings 62A can be substantially equalized by substantially evacuating the duct 100 with the exhaust fan 200. For this reason, the airflow through each charger 52 can be brought into substantially the same state, and the backflow of air in each charger 52 can be equally prevented.

Since the duct 100 is used as a gear box for housing the gear mechanisms 310 and 320, the number of parts can be reduced.

Since the motors 330 and 340 are provided in the duct 100, the motors 330 and 340 can be cooled by air flowing through the duct 100.

The present invention is not limited to the above-described embodiment and various changes may be made therein as illustrated in the following examples. In the following description, the same reference numerals will be used to designate substantially the same components as those in the above-described embodiment, and the description thereof will be omitted.

In the above-described embodiment, four first openings 61A and four second openings 62A corresponding to four process cartridges are provided. However, the present invention is not limited to this. If the number of the process cartridges is, for example, three, three first openings 61A and three second openings 62A may be provided.

In the above-described embodiment, the left and right side walls 61 and 62 of the drawer 60 (parts of the drawer 60) are illustrated as an example of a pair of frames. However, the present invention is not limited to this. For example, as shown in FIG. 6, a pair of frames may be a pair of side frames 13 and 14 located on the inner side of side panels forming the left and right outer walls of the apparatus main body 10.

That is to say, in a configuration in which a plurality of process cartridges 50 are directly attached to and removed from a pair of side frames 13 and 14 forming the apparatus main body 10, first openings 61A and second openings 62A are provided in the pair of side frames 13 and 14, respectively.

Figure 6:
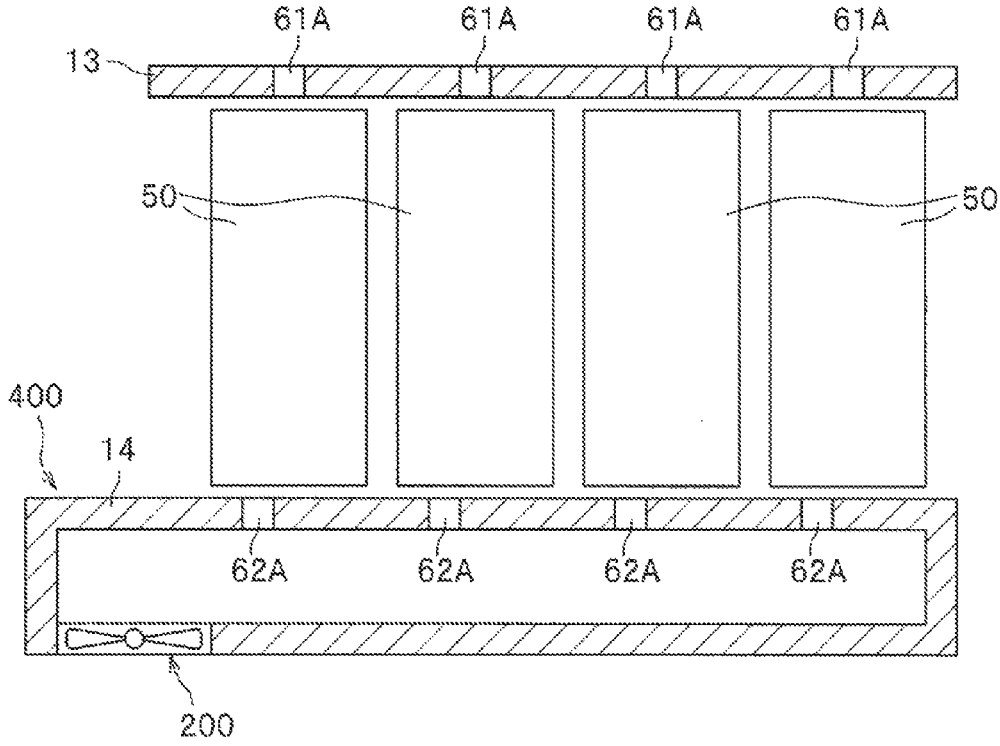
FIG. 6 is an explanatory diagram showing an embodiment in which a pair of frames is provided in an apparatus main body.

As shown in FIG. 6, the side frame 14 may form part of a duct 400.

Figure 7:
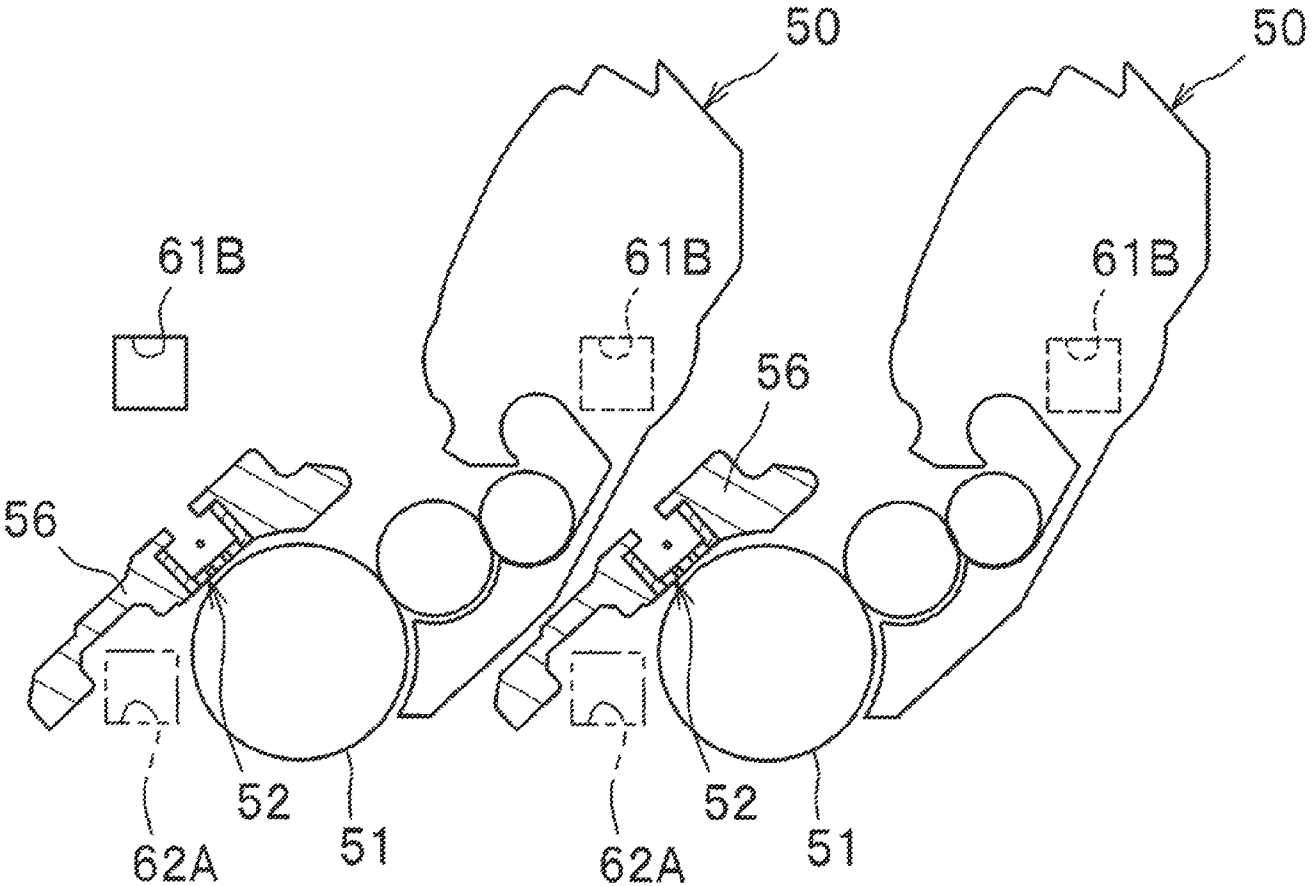
FIG. 7 is an explanatory diagram showing an embodiment in which first openings overlap with process cartridges as viewed from the axial direction.

In the above-described embodiment, the first openings 61A are provided at positions where the first openings 61A do not overlap with the process cartridges 50 as viewed from the axial direction. However, the present invention is not limited to this. For example, as shown in FIG. 7, the first openings 61B may be provided at positions where the first openings 61B overlap with the process cartridges 50 as viewed from the axial direction. Specifically, a first opening 61B corresponding to one process cartridge 50 may be formed at a position where the first opening 61B overlaps with another process cartridge 50 adjacent to the charger supporting wall 56 of the one process cartridges 50 as viewed from the axial direction. Also in this case, the same airflow as in the above-described embodiment can be made.

In the above-described embodiment, an exhaust fan 200 that discharges the air in the apparatus main body 10 to the outside is used as a fan. However, the present invention is not limited to this. Instead, a suction fan that sucks outside air into the apparatus main body may be used. In this case, the suction fan is provided on the outer side of the frame in which first openings are formed.

In the above-described embodiment, the present invention is applied to a color printer 1. However, the present invention is not limited to this. The present invention may be applied to any other image forming apparatus, for example, a copying machine or a multifunction device.

What is claimed is:

1. An image forming apparatus comprising:

a plurality of process cartridges arranged in one direction, each of the plurality of process cartridges comprising a photosensitive drum, a charger configured to charge the photosensitive drum and a charger supporting wall supporting the charger; and a pair of frames disposed on an outer side in an axial direction of the photosensitive drums and configured to support the plurality of process cartridges therebetween, wherein:

one of the pair of frames has a plurality of first openings which correspond to the plurality of process cartridges such that air outside the pair of frames is sucked between the pair of frames through the plurality of first openings;

the other of the pair of frames has a plurality of second openings which correspond to the plurality of process cartridges such that air between the pair of frames is discharged outside the pair of frames through the plurality of second openings; and as viewed from the axial direction, the first openings are positioned on an opposite side of the charger supporting wall from the photosensitive drum, and the second openings are positioned on the same side of the charger supporting wall as the photosensitive drum.

2. The image forming apparatus according to claim 1, wherein as viewed from the axial direction, the first openings are positioned at positions not overlapping with the process cartridges.

3. The image forming apparatus according to claim 1, further comprising:

a fan disposed on the outer side in the axial direction of the other of the pair of frames and configured to discharge air in an apparatus main body to the outside of the apparatus main body; and a duct configured to extend from the second openings to the fan.

4. The image forming apparatus according to claim 3, wherein the duct is configured to house a gear mechanism for driving the photosensitive drums or developing rollers for supplying developer to the photosensitive drums.

5. The image forming apparatus according to claim 4, wherein the duct is configured to house a driving source for driving the gear mechanism.

6. The image forming apparatus according to claim 3, wherein the duct has third openings facing the second openings to communicate an inside of the pair of frames with an inside of the duct.

7. The image forming apparatus according to claim 1, further comprising a photosensitive drum support configured to integrally support the plurality of process cartridges and to be movable in an apparatus main body, wherein the photosensitive drum support includes the pair of frames.

8. The image forming apparatus according to claim 1, wherein the second openings are positioned below the chargers.

9. The image forming apparatus according to claim 1, wherein the charger supporting wall is positioned between the pair of frames to guide air introduced through the first openings into the second openings.

* * * * *